US005563382A

United States Patent [19]

Choyce

[11] Patent Number: 5,563,382

[45] Date of Patent: Oct. 8, 1996

[54] SILENCER FOR COMPRESSED AIR

[75] Inventor: Alan B. Choyce, Bodegraven, Netherlands

[73] Assignee: Q.E. International B.V., Bodegraven, Netherlands

[21] Appl. No.: 290,836

[22] PCT Filed: Feb. 18, 1993

[86] PCT No.: PCT/NL93/00037

§ 371 Date: Aug. 19, 1994

§ 102(e) Date: Aug. 19, 1994

[87] PCT Pub. No.: WO93/17273

PCT Pub. Date: Sep. 2, 1993

[30] Foreign Application Priority Data

Feb. 19, 1992 [NL] Netherlands ..... 9200313

[51] Int. Cl.[6] ..... F01N 3/02

[52] U.S. Cl. ..... 181/230; 181/264; 181/282

[58] Field of Search ..... 181/230, 224, 181/264, 269, 272, 275, 281, 282

[56] References Cited

U.S. PATENT DOCUMENTS 2,043,030 6/1936 Bourne .
2,490,493 12/1949 Wade .
3,361,227 1/1968 Kaari .
4,011,922 3/1977 Goplen ..... 181/272
4,079,809 3/1978 Visnapuu et al. ..... 181/230

FOREIGN PATENT DOCUMENTS 2007046 10/1970 Germany .
3445014 6/1985 Germany .

*Primary Examiner*—Khanh Dang
*Attorney, Agent, or Firm*—Young & Thompson

[57] ABSTRACT

A silencer for silencing outlet pulses of compressed air, comprises an elongated housing provided with an inlet and an outlet. Fitted in the housing between the inlet and outlet, are at least two sound-absorbent elements each comprising a transverse member which extends from the longitudinal center line of the housing perpendicularly thereto and at least on two sides terminates at a distance from the housing, the transverse member has, at the end of those sides, a plate which is air impermeable and which extends essentially parallel to the longitudinal center line of the housing. The part of the baffle between the two sides extends up to the wall of the housing. The inlet and outlet open into the housing at locations spaced from the area defined between the plates, and the free cross-sectional surface area between the plates and the housing is less than 15% of the total cross-sectional surface area of the housing at the location of the plates.

12 Claims, 4 Drawing Sheets

SILENCER FOR COMPRESSED AIR

FIELD OF THE INVENTION

The present invention relates to a silencer for compressed air.

BACKGROUND OF THE INVENTION

A silencer of this type is disclosed in U.S. Pat. No. 3,361,227. The silencer described and illustrated in said patent is particularly suitable for silencing the exhaust sound from a combustion engine. Because the efficiency of combustion engines is of considerable importance, a balance must be sought between silencing of the sound and impedance of the gas flow. Silencing of pans of the audio spectrum which are not covered by the silencer in question is provided by additional silencers connected up- or downstream. The effort involved in this type of construction is, on the one hand, justified by the reduced loss which occurs as a result and, on the other hand, possible because, especially in vehicles, a long length is available for the installation of such silencers.

Silencers of this type are unsuitable for compressed air compressors. In the prior art silencers lined with sound-absorbent material are used for compressed air compressors. Silencers of this type have the advantage that a broad audio spectrum can be covered by a single silencer. In this context efficient silencing is more important than the impedance of the gas flow because it is possible to compensate for losses in flow in a simple manner, for example by increasing the power of the motor which drives the compressor. However, the use of silencers lined with glass wool or another absorbent material has the disadvantage that silencers of this type can no longer be cleaned such that they meet the demands of the foodstuffs industry and hospitals. Frequently the minimum requirement for these sectors is that the silencers can be sterilised of flushed with a liquid disinfectant.

OBJECT OF THE INVENTION

The object of the present invention is to provide a silencer which does not have the abovementioned disadvantages.

SUMMARY OF THE INVENTION

The invention is based on the perception of incorporating only plates, baffles and other components which can be sterilised easily. In addition, the design of the sound-absorbent element is such that silencing of, in particular, the low frequency sound produced by the compressor can be provided to a great extent. According to an advantageous embodiment of the invention, the free cross-sectional surface area between the plate and the housing makes up between 8 and 12% of the given total cross-sectional surface area. Although the gap between housing and plate can be provided locally or as a gap extending around the circumference, according to an advantageous embodiment of the invention plates are fitted at a distance from the housing on two opposite sides of the transverse baffle.

Further silencing means, comprising a transverse element which extends from the longitudinal centre line perpendicularly thereto at least on one side terminates at a distance away from the housing, the transverse element being provided at said end on said side with a plate element extending in the direction of the outlet, are present for further absorption of the sound. An additional silencing chamber is formed by this means. The two U-shaped silencers formed in this way can be located some distance apart or can adjoin one another. If said silencers are some distance apart, an intermediate baffle can be placed between them, which, in its turn, delimits two further chambers. In order to provide adequate silencing coupled, on the other hand, with optimum use of the space in the housing, according to an advantageous embodiment of the invention the length of the plate is at least 10% of the total length of the housing.

Optimum silencing is provided by this means. For silencing high frequency sound, sieve baffles containing openings can be filled between the plate-shaped elements and extending essentially perpendicular thereto. For optimum silencing of high frequency sound it proves advantageous to install at least three such baffles horizontally some distance apart, the mutual spacing between the baffles decreasing towards the transverse baffle.

For further silencing of the sound, the outlet comprises a tube projecting into the housing, the free end of the tube being closed and that section of the tube wall which is located within the housing being provided with openings. The openings preferably have a diameter of less than 3 mm.

The invention will be explained in more detail below with reference to an illustrative embodiment shown in the drawing. In the drawing.

DETAILED DESCRIPTION OF THE PREFERRED EMBODIMENTS

Figure 1:
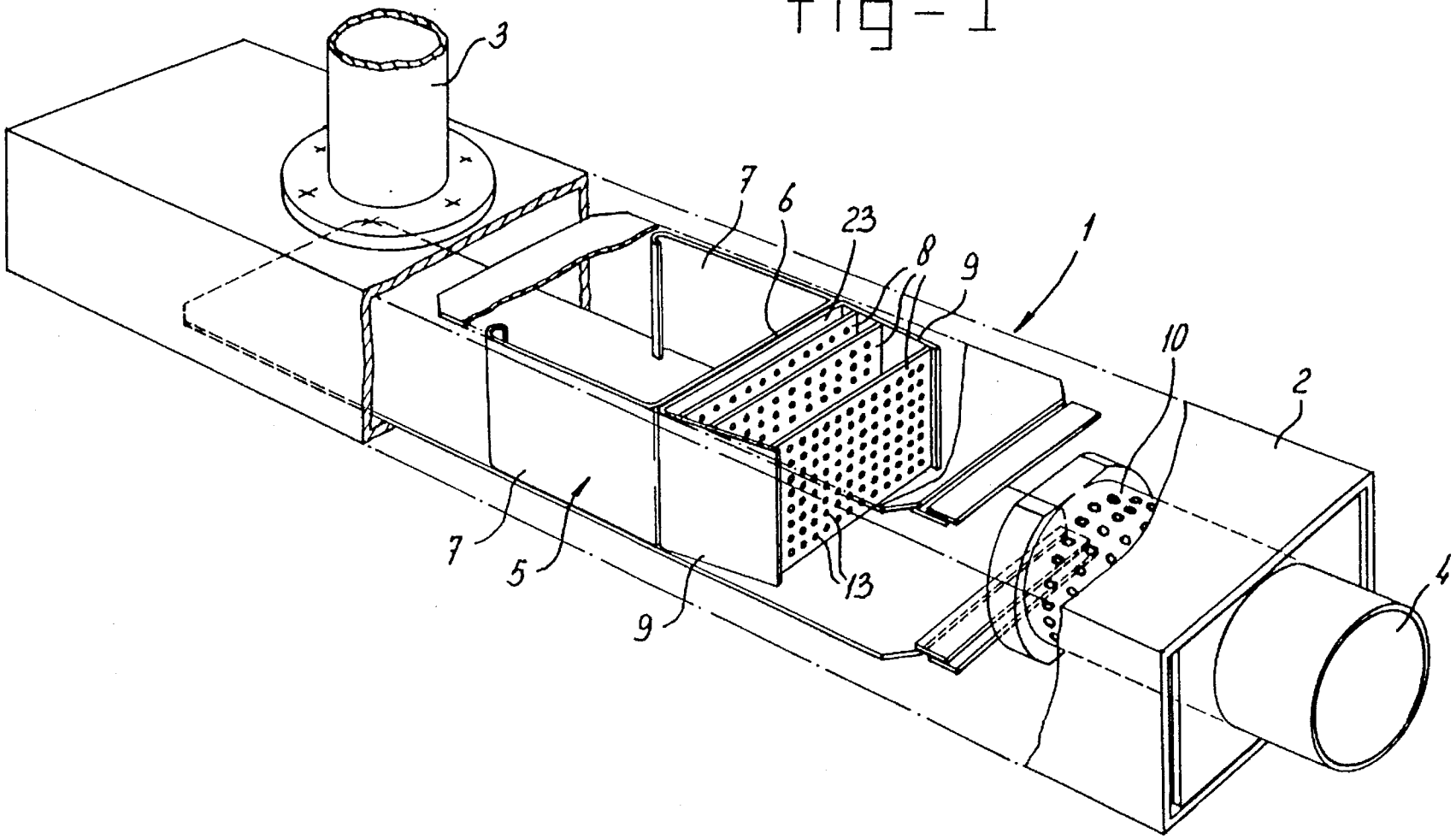
FIG. 1 shows a partially exploded perspective view of the silencer according to one embodiment of the invention.
Figure 2:
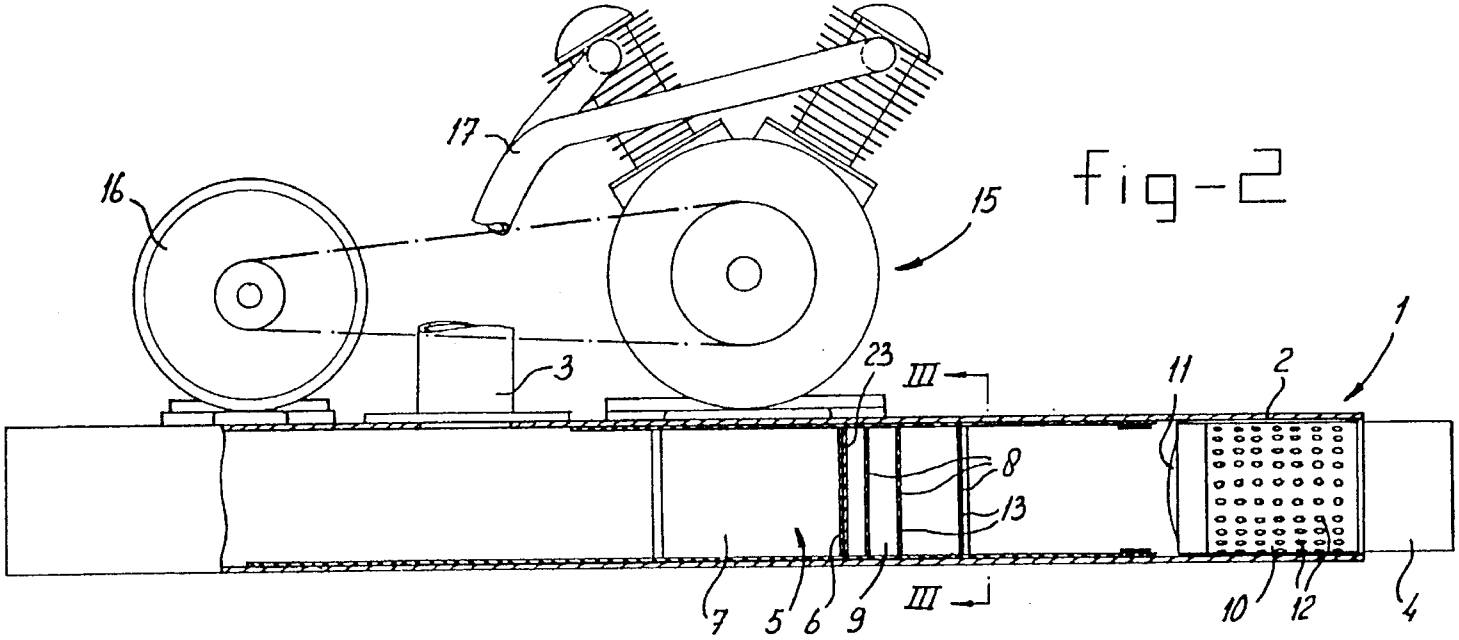
FIG. 2 shows a side view, in partial cross-section, or the silencer according to the invention with a compressor connected thereto.
Figure 3:
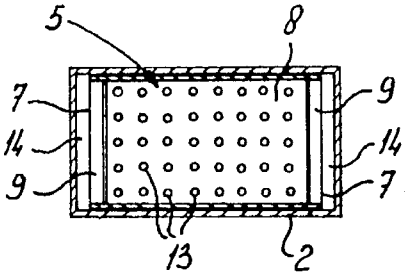
FIG. 3 shows a cross-section along the line III—III in FIG. 2.

In FIG. 1 the silencer according to the invention is designated in its entirety by 1. This silencer comprises a rectangular housing 2 provided with an inlet 3 for compressed air and an outlet 4. The silencer incorporates a sound-absorbent element 5. This element comprises a closed transverse baffle 6, the top and bottom of which are fixed to the housing in an airtight manner and the sides of which are provided with plates 7 which extend to within some distance of the side wall of the housing 5. This can also be seen in FIG. 3, where the gap concerned is indicated by 14. The end of plate 7 is bent over somewhat in order, on the one hand, to restrict the pressure loss of the amount of compressed air and/or gas flowing by and, on the other hand, to increase the resistance of the plates 7 to vibrations. The total surface area of the of the gap 14, i.e. in this illustrative embodiment the total surface area of the two gaps 14 opposite one another, is between 8 and 12% of the total surface area of the cross-section of the housing at the location of said plates 7. The volume present between inlet 3 and gaps 14 is such that an initial sound absorption occurs as a result of expansion of the gas entering said volume. This volume is preferably designed in such a way that the length of the plates 7 makes up 10–30% of the total length of the housing. The construction shown here of silencing element and housing with gaps 14 delimited between them is particularly suitable for silencing the low frequency portion of the sound in the fluid supplied. Sieve baffles 8 fixed with the aid of two plate elements 9, which are somewhat tapered in the direction of the outlet 4, are provided for silencing the high frequency portion of the sound. Said plate elements 9 are fixed to transverse element 23. It can be seen from the drawing that in this example three sieve baffles are present, the spacing between them decreasing towards transverse baffle 6. Particularly efficient silencing can be achieved in this way. Values of more than 15 db have been measured for high frequency sound. i.e. above about 1000 Hz. Plate elements 9, which accommodate the sieve baffles 8 between them, are designed somewhat tapered towards the direction of the outlet in order as far as possible to restrict the outflow losses of the gas which flows past the plates 7. Said silencing element is connected to a free chamber in the housing in which outlet 4 is installed. Said outlet comprises a tube 10 which is closed at end 11, as can be seen in particular from FIG. 2. This closure is of somewhat curved design in order to provide it with maximum strength. Openings 12 are made in the wall of tube 10. Said openings are made as small as possible and a size which has been found to be achievable in practice is at most 3 mm. The housing shown here is of rectangular design for carrying a compressor without giving rise to further fixing problems. Said compressor, or any other positive displacement device, is shown diagrammatically in FIG. 2 and indicated by 15, whilst the drive motor is indicated by 6. The connection between the outlet 17 of the compressor and inlet 3 is not further shown and said connection can comprise any means disclosed in the prior art, such as reducing and control devices and filters and/or separators. Although the transverse baffle 6 in the preferred embodiment according to FIG. 1 is a straight baffle, it must be understood that said baffle can also be bent or convex so as to be able better to absorb the forces acting thereon. For example, it is possible to design transverse baffle 6 to be convex in the direction of the outlet.

Figure 4:
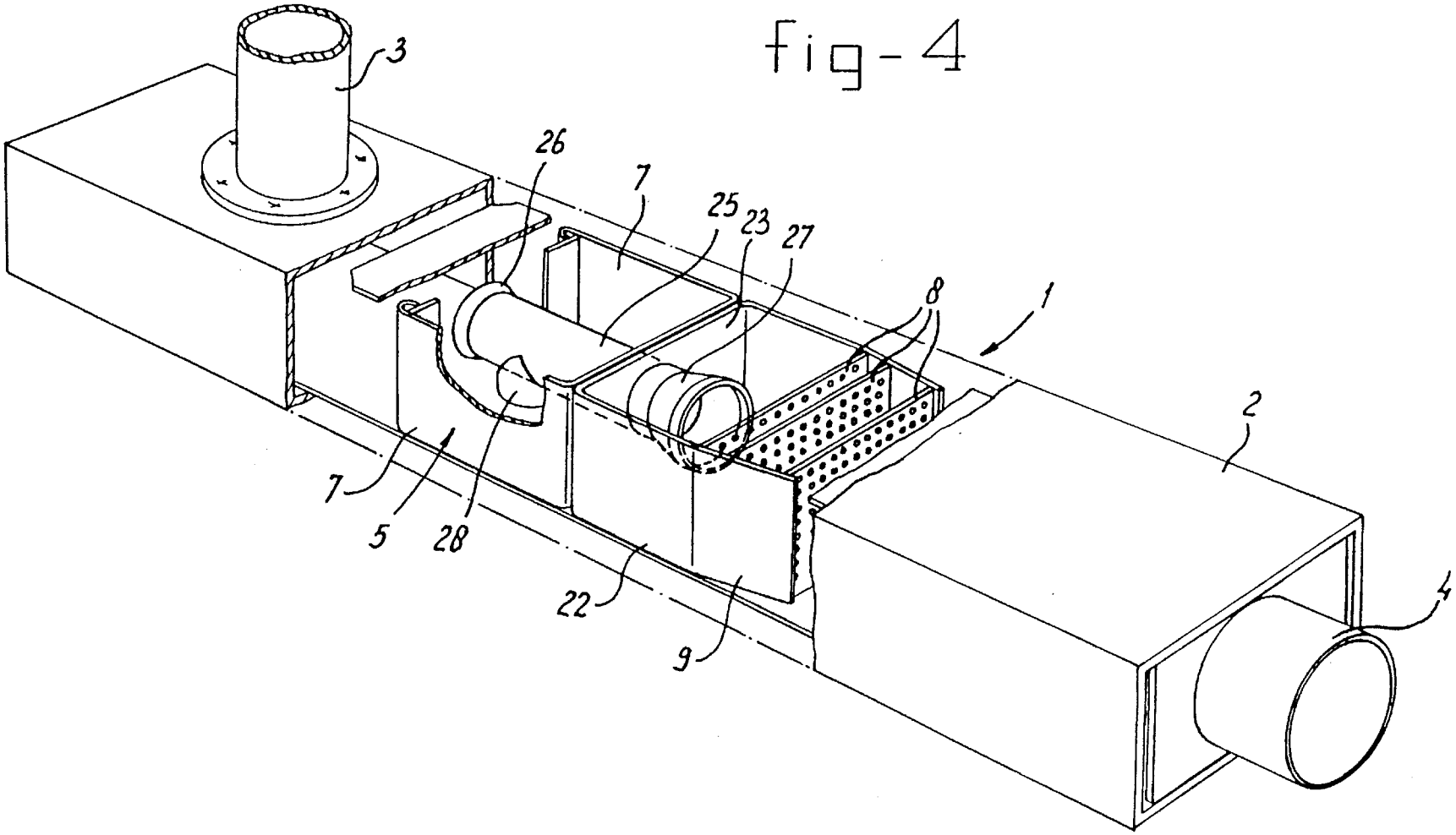
FIG. 4 shows a perspective view of a further embodiment according to the invention.

FIG. 4 shows an embodiment of the installation according to the invention in which a circular pipe which produces an increased pressure drop is fitted in the transverse baffle 6. Said pipe is indicated by 25 and comprises a somewhat conically tapered inlet section 26 and a more pronouncedly conically flared outlet section 27. Said pipe 25 is supported by support 28. The sieve baffles are, of course, somewhat offset in order to be able to accommodate pipe 25.

Figure 5:
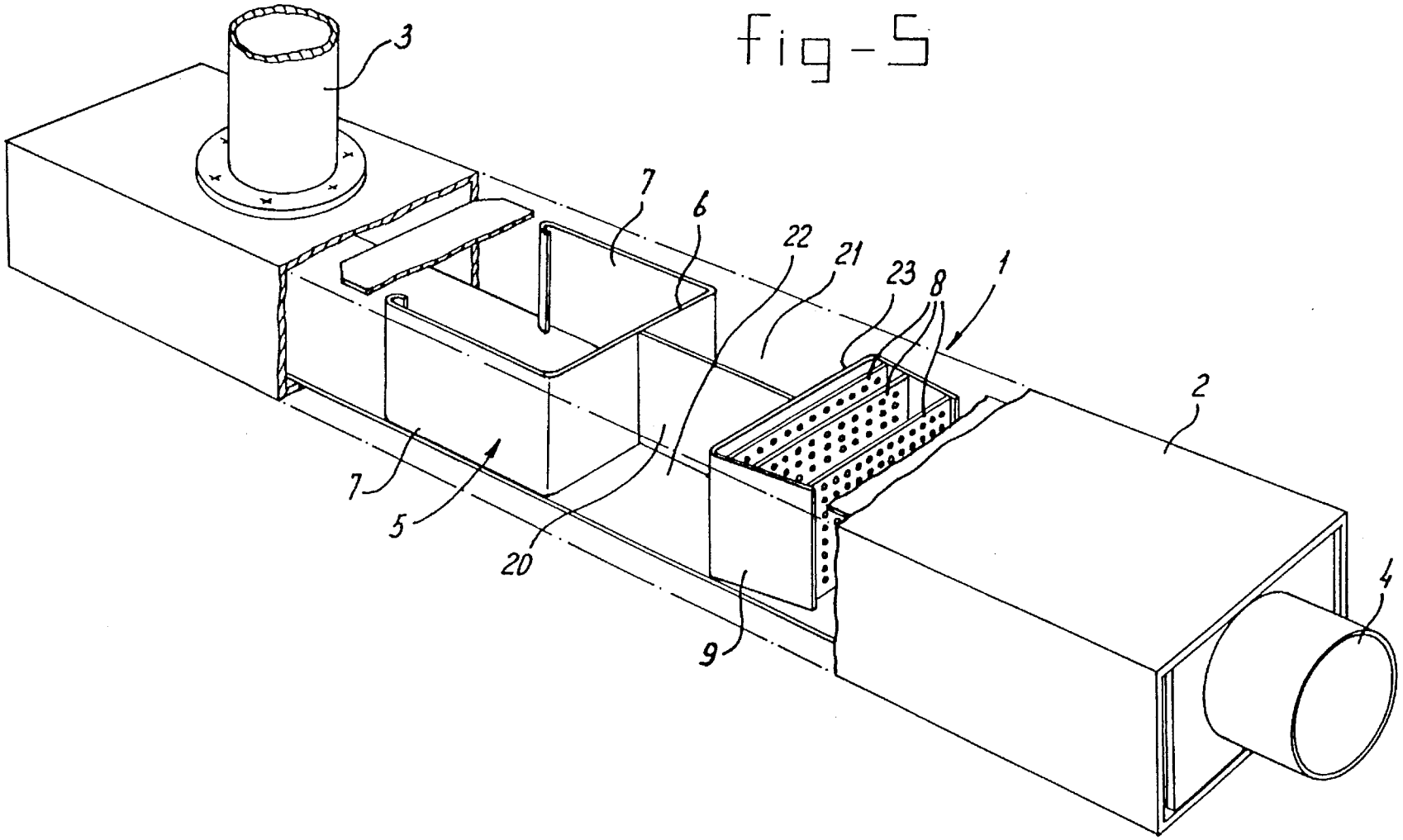
FIG. 5 shows a perspective view according to FIG. 1 of a further embodiment according to the invention.

FIG. 5 shows a further embodiment of the silencer according to the invention. In this embodiment the transverse baffle 6 is not connected to transverse element 23, as in the previous figures, but an intermediate baffle 20 is placed between the two. Two chambers 21 and 22 are created by this means. Further silencing of the low frequency portion of the sound is provided as a result.

Although the housing is shown here as rectangular, it is obvious that said housing can have any other shape, such as square, round and the like. It is also possible to design gap 14 to extend over a smaller or greater portion of the circumference of the housing.

These and other embodiments will be regarded as obvious by those skilled in the an following the above description and also fall within the scope of the present application. It is also possible to provide the inlet and the outlet in a different position on the housing.

I claim:

1. A silencer for silencing outlet pulses of compressed air comprising an elongated housing provided with an inlet and an outlet having, fitted in the housing between the inlet and outlet, at least two sound-absorbent elements each comprising a transverse member which extends from the longitudinal centre line of the housing perpendicularly thereto and at least on two sides terminating at a distance from the housing, the transverse member being provided at the end of said sides with a plate which is air impermeable and which extends essentially parallel to the longitudinal centre line of the housing, and wherein the part of the baffle between the two sides extends until the wall of the housing, wherein the inlet and outlet open into the housing at locations spaced from the area defined between the plates, and wherein the free cross-sectional surface area between the plates and the housing is less than 15% of the total cross-sectional surface area of the housing at the location of said plate.

2. A silencer according to claim 1, wherein the free cross-sectional surface area is between 8 and 12% of the total cross-sectional surface area of the housing at the location of the plate.

3. A silencer according to claim 1, wherein plates are fitted some distance away from the housing on two opposite sides of the transverse baffle.

4. A silencer according to claim 1, wherein the length of the plate is at least 10% of the total length of the housing.

5. A silencer according to claim 1, wherein plate elements are fitted at two opposite sides of the transverse element at a distance from the housing.

6. A silencer according to claim 1, wherein at least one sieve baffle which is provided with openings and extends from the plate elements essentially perpendicularly to the longitudinal centre line of the housing is present.

7. A silencer according to claim 6, wherein at least three sieve baffles are present and wherein the spacing between the sieve baffle decreases in the direction of the transverse element.

8. A silencer according to claim 1, wherein the transverse element adjoins the transverse baffle.

9. A silencer according to claim 1, wherein an intermediate baffle which extends parallel to the longitudinal centre line of the housing and divides the space between the transverse element and the transverse baffle into two chambers is fitted between the transverse baffle and the transverse element.

10. A silencer according to claim 1, wherein the outlet comprises a tube which projects into the housing, the free end of the tube being closed and that section of the tube which is located within the housing is provided with openings.

11. A silencer according to claim 10, wherein the diameter of the openings is less than 3 mm.

12. A silencer according to claim 1, wherein a silencer tube is accommodated in the transverse baffle.

* * * * *